United States Patent [19]

Neyret

[11] Patent Number: 4,895,213

[45] Date of Patent: Jan. 23, 1990

[54] PRESS WITH A KNUCKLE JOINT ESCAPEMENT

[76] Inventor: Guy Neyret, 11, rue du Fort, 69340 Francheville, France

[21] Appl. No.: 264,360

[22] Filed: Oct. 31, 1988

[30] Foreign Application Priority Data

Nov. 6, 1987 [FR] France ..... 87 14751

[51] Int. Cl.[4] ..... B25D 9/00

[52] U.S. Cl. ..... 173/119; 173/90; 72/436

[58] Field of Search ..... 173/119, 122, 124, 90; 72/436, 437

[56] References Cited

U.S. PATENT DOCUMENTS

| | | | |
|---|---|---|---|
| 1,633,995 | 6/1927 | Miller | 173/124 |
| 1,959,516 | 5/1934 | Baker | 173/122 |
| 2,080,130 | 5/1937 | Hansen | 173/124 |
| 2,594,522 | 4/1952 | Thompson | 173/119 |
| 2,626,598 | 1/1953 | Arwater | 173/119 |
| 2,772,858 | 12/1956 | Galvez | 173/122 |
| 2,787,178 | 4/1957 | Maxim | 173/119 |
| 3,063,508 | 11/1962 | Henry | 173/122 |
| 4,159,634 | 7/1979 | Stengard | 72/436 |

FOREIGN PATENT DOCUMENTS

| | | | |
|---|---|---|---|
| 195625 | 2/1908 | Fed. Rep. of Germany . | |
| 1099458 | 9/1955 | France . | |
| 2343531 | 10/1977 | France . | |
| 0713680 | 2/1980 | U.S.S.R. | 173/119 |
| 920195 | 3/1963 | United Kingdom . | |

*Primary Examiner*—David Jones
*Attorney, Agent, or Firm*—Young & Thompson

[57] ABSTRACT

An impact press of the type including a tool holder slidably mounted in a slide, a hammer sliding in the slide, and a spring resiliently acting between the hammer and the slide to urge the hammer toward the tool holder. An escapement device disengages the spring from the hammer in a determined position of the stroke. This escapement device includes two connecting rods articulated to each other about an axle at one end and the other end of which is articulated about axles respectively to the hammer and to the tool holder. A return spring urges the connecting rods back to an aligned position in which the articulation axles are in alignment along a straight line parallel to the path of the hammer. One of the connecting rods includes a ramp with which cooperates a pin rigidly connected to the slide such that when the ramp contacts the pin, the connecting rods are deflected from alignment with each other. An abutment rigidly connected to the press limits the return backward motion of the tool holder.

2 Claims, 1 Drawing Sheet

PRESS WITH A KNUCKLE JOINT ESCAPEMENT

FIELD OF THE INVENTION

The invention relates to an impact press of the type including a tool holder slidably mounted in a slide entrained and subjected to the action of a hammer resiliently charged and sliding in said slide, an escapement device disengaging the resilient charge from the slide in a determined position of the stroke.

The resilient charge which is thus freed drives vigorously the hammer which strikes the tool holder the tool of which is bearing against the part after the first stroke or approach stroke.

BACKGROUND OF THE INVENTION

In the known impact presses, the escapement systems use generally a radial escapement with balls or circular segments coming opposite holes or grooves in a position of advance of the slide. Said balls or segments support the full charge of the resilient charge, generally constituted by a spring, so that the mechanism is subject to an intensive wear.

OBJECTS AND SUMMARY OF THE INVENTION

The object of the present invention is to provide a new escapement system for an impact press, which causes practically no wear to the meachanism while being of a simple and economic construction and of reliable operation.

To this effect, the impact press according to the invention is characterized by the fact that said escapement device includes two connecting rods articulated to each other at one end and the other end of which is articulated respectively to the hammer and to the tool holder, a return spring tending to urge the connecting rods back to an aligned position in which articulation axles of the connecting rods are in alignment along a straight line parallel to a path of movement of the hammer, one of the connecting rods including a ramp with which cooperates a pin rigidly connected to the slide.

This cooperation of the pin with a cam of one of the connecting rods causes a flexure of the knuckle joint constituted by the two connecting rods, said knuckle joint being realigned when the slide moves backwards under the action of the return spring.

BRIEF DESCRIPTION OF THE DRAWING

The invention will be better understood from the reading of the following description with reference to the accompanying drawing wherein.

DETAILED DESCRIPTION OF THE INVENTION

Figure 1:
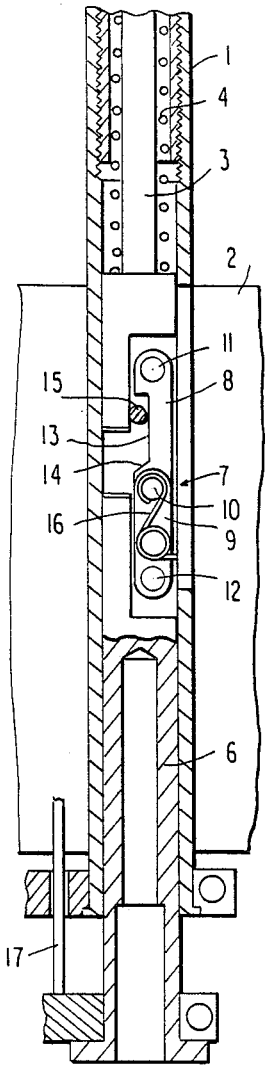
FIG. 1 is an axial sectional schematic view of an impact press according to an embodiment of the invention, in an open position.

The press includes a slide 1 driven in translation with respect to a frame 2 by any convenient means such as a lever with a pinion and rack unit or a connecting rod for a manual operation, a crank for a mechanical operation, or a jack for a pneumatic operation.

Inside the slide 1 is disposed a sliding hammer 3 subjected to the action of a compression spring 4. Spring 4 is abutting against a nut 5 screwed onto slide 1 in order to initially set the pressure of spring 4. Inside slide 1 is also accommodated a sliding tool holder 6.

Figure 2:
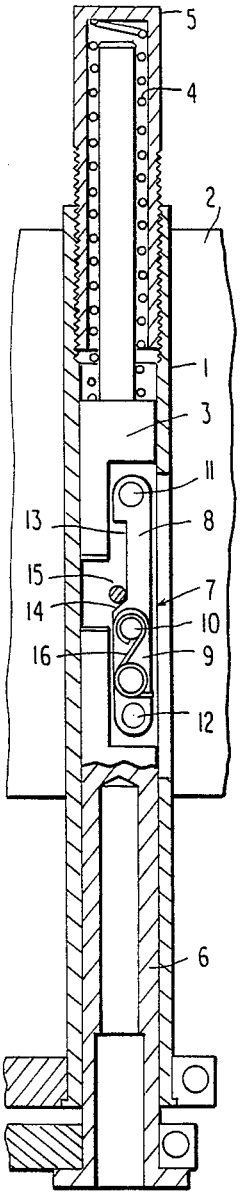
FIG. 2 is similar to FIG. 1, for an intermediate position of the press.

According to the invention, hammer 3 and tool holder 6 are connected to each other via a knuckle joint 7. This system is constituted of two connecting rods 8, 9, articulated to one another at one end about an axle 10. The other end of the connecting rod 8 is articulated on an axle 11 rigidly connected with the hammer 3 while the other end of the connecting rod 9 is articulated on an axle 12 rigidly connected to the tool holder 6. The arrangement is such that when the knuckle joint 7 is unfolded (FIGS. 1 and 2), axles 10, 11, 12 are in alignment on a straight line parallel to the movement of slide 1.

Connecting rod 8 is formed with a side cut-out 13 ending in a ramp 14, a pin 15 rigidly connected to slide 1 sliding inside cut-out 13 when the knuckle joint 7 is unfolded. A return spring 16 acting on axle 10 acts so as to unfold knuckle joint 17.

At rest (FIG. 1), the connecting rods 8, 9 are in alignment and knuckle joint 7 is rigid. After the approach stroke, the punch carried by the tool holder 6 comes to bear on the workpiece, and the assembly formed by the punch, the tool holder 6, the connecting rods 8 and 9 and the hammer becomes fixed, slide 1 being further moved by compression spring 4.

Figure 3:
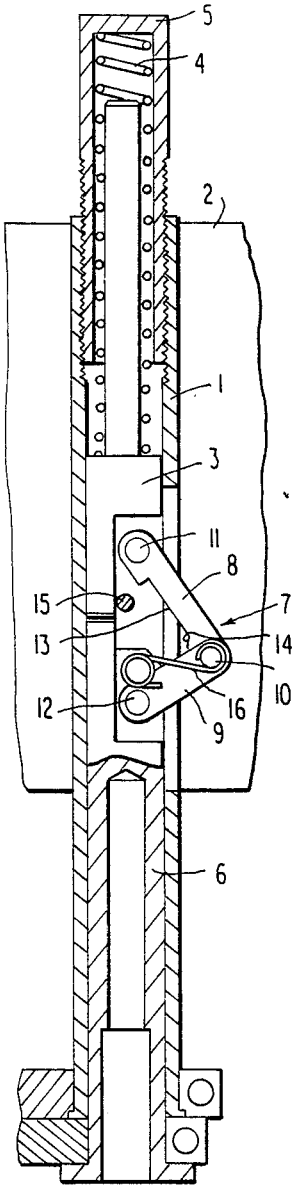
FIG. 3 is similar to FIGS. 1 and 2, for the closed position of the press.

At a certain position on the path of slide 1 (FIG. 2), pin 15 which has previously slid along cut-out 13 comes into engagement with ramp 14. By further advancing, slide 1 entrains pin 15 which contacts ramp 14 and thereby cams connecting rod 8 towards the right (in the drawing). Axle 10 is no longer in alignment with axles 11 and 12, so knuckle joint 7 is no longer rigid and thus folds. This folding allows hammer 3 to strike the tool holder 6 under the action of spring 4 (FIG. 3).

During the backward motion of slide 1, return spring 16 reopens knuckle joint 7. In order to facilitate this reopening one can provide an abutment 17 rigidly connected to frame 2 and which stops the tool holder 6.

I claim:

1. An impact press of the type including a tool holder slidably mounted in a slide, a hammer sliding in said slide, means resiliently acting between the hammer and the slide to urge the hammer toward the tool holder, an escapement device disengaging the resiliently acting means from the hammer in a determined position of the stroke, characterized by the fact that said escapement device includes two connecting rods articulated to each other about an axle at one end and the other end of which is articulated about axles respectively to the hammer and to the tool holder, a return spring tending to urge the connecting rods back to an aligned position in which the articulation axles are in alignment along a straight line parallel to the path of the hammer, one of the connecting rods including a ramp with which cooperates a pin rigidly connected to the slide such that when the ramp contacts the pin, the connecting rods are deflected from alignment with each other.

2. An impact press according to claim 1, characterized by an abutment rigidly connected to the press and limiting the return backward motion of said tool holder.

* * * * *